US006860170B2

(12) United States Patent
DeForest

(10) Patent No.: US 6,860,170 B2
(45) Date of Patent: Mar. 1, 2005

(54) ELECTRONIC THROTTLE CONTROL HYSTERESIS MECHANISM

(75) Inventor: Jason Dale DeForest, Bellaire, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 306 days.

(21) Appl. No.: 10/237,512

(22) Filed: Sep. 9, 2002

(65) Prior Publication Data

US 2004/0045393 A1 Mar. 11, 2004

(51) Int. Cl.[7] ..... G05G 1/14
(52) U.S. Cl. ..... 74/512; 74/514; 74/560
(58) Field of Search ..... 74/512, 513, 514, 74/560; 123/399; 192/75, 76; 188/78, 325, 334, 342

(56) References Cited

U.S. PATENT DOCUMENTS

| | | | | |
|---|---|---|---|---|
| 4,869,220 | A | | 9/1989 | Imoehl |
| 4,944,269 | A | | 7/1990 | Imoehl |
| 4,958,607 | A | | 9/1990 | Lundberg |
| 5,133,225 | A | | 7/1992 | Lundberg |
| 5,385,068 | A | | 1/1995 | White |
| 5,408,899 | A | | 4/1995 | Stewart |
| 5,507,201 | A | | 4/1996 | Fairbairn |
| 5,529,296 | A | | 6/1996 | Kato |
| 5,563,355 | A | | 10/1996 | Pluta |
| 5,697,260 | A | | 12/1997 | Rixon |
| 5,868,040 | A | | 2/1999 | Papenhagen |
| 5,934,152 | A | | 8/1999 | Aschoff |
| 5,937,707 | A | | 8/1999 | Rixon |
| 6,098,971 | A | | 8/2000 | Stege et al. |
| 6,186,025 | B1 | * | 2/2001 | Engelgau et al. ..... 74/512 |
| 6,220,222 | B1 | * | 4/2001 | Kalsi ..... 123/399 |
| 6,360,631 | B1 | | 3/2002 | Wortmann |
| 6,474,191 | B1 | * | 11/2002 | Campbell ..... 74/514 |
| 6,718,845 | B2 | * | 4/2004 | Menzies ..... 74/512 |
| 6,725,741 | B2 | * | 4/2004 | Menzies ..... 74/514 |
| 2003/0047023 | A1 | * | 3/2003 | Huesges et al. ..... 74/514 |

FOREIGN PATENT DOCUMENTS

| | | | | |
|---|---|---|---|---|
| EP | 000974886 A2 | * | 1/2000 | ..... 74/512 |

* cited by examiner

*Primary Examiner*—Vinh T. Luong
(74) *Attorney, Agent, or Firm*—Porter Wright; Richard M. Mescher; Dean B. Watson

(57) ABSTRACT

A control pedal assembly includes a support structure having a guide surface and a pedal arm carrying a pedal at a lower end of the pedal arm. The pedal arm is pivotable relative to the support structure about a pivot axis between a released position and an applied position. A hysteresis device is secured to an upper end of the pedal arm and engages the guide surface so that the hysteresis device slides along the guide surface as the pivot arm pivots between the released position and the applied position. A distance between the guide surface and the pivot axis varies so that the hysteresis device applies an increasing normal force to the guide surface to create an increasing friction force that opposes sliding motion of the hysteresis device as the pedal arm pivots from the released position to the applied position.

19 Claims, 7 Drawing Sheets

10
38
34
36
42
40
18
38
20
66
34
22
78
76
78
12
32
62
54
50
60
82
24
64
80
16
52
32
32
58
62
64
60
32
14
56

38
34
102
36
34
20
104
38
112
22
114
12
62
54
32
50
60
24
64
80
82
16
52
32
58
62
32
60
32
64
14
56
100

ELECTRONIC THROTTLE CONTROL HYSTERESIS MECHANISM

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a control pedal assembly for a motor vehicle and, more particularly, to a control pedal assembly for a motor vehicle which is electronically coupled and has a mechanical hysteresis device to simulate the feel of a control pedal assembly which is mechanically coupled.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. The control pedals are typically connected to control devices by push-pull cables, rods, or other mechanical transmission devices which convert the limited rotary motion of the pedals into useful mechanical motion at the control devices to control operation of the motor vehicle. The engine throttle is typically connected to an accelerator pedal through a mechanical cable such as a Bowden cable. This mechanical linkage has a desirable and functional "feel" wherein the pressure required for advancing the control pedal to accelerate the motor vehicle is greater than the pressure required for maintaining the pedal in a fixed position to maintain the motor vehicle at a constant speed. This difference of required pressures is often referred to as a "hysteresis effect". The pressure required to advance the control pedal is typically relatively high. This is desirable to obtain adequate return pressure to return the pedal to the idle position in a desired amount of time when foot pressure is removed from the control pedal. The pressure required to advance the control pedal is easily provided when accelerating but would become uncomfortable over time to maintain a relatively constant speed. Therefore, the hysteresis effect is important in providing a reasonable force for maintaining the accelerator pedal in position to comfortably drive at a generally constant speed while providing an adequate return force for returning the control pedal to idle to decelerate the motor vehicle.

There have been many attempts to introduce an electrical linkage between the control pedal and the control device. Typically, a position sensor converts the position of the control pedal into an electrical signal which is sent to the control device. This electrical linkage has far fewer routing limitations than the mechanical linkages. The control pedal, however, must be provided with a hysteresis device to obtain the "feel" of a control pedal having a mechanical linkage. Various proposals have been made to provide a control pedal with both an electrical linkage and a mechanical hysteresis device. While these proposed control pedals may adequately provide the "feel" of a control pedal with a mechanical linkage, they are relatively complex and expensive to produce. Additionally, the proposed control pedals require a relatively large amount of space. Accordingly, there is a need in the art for a control pedal assembly which is electronically coupled and has a mechanical hysteresis device, is relatively simple and inexpensive to produce, and/or is highly reliable in operation.

SUMMARY OF THE INVENTION

The present invention provides a control pedal assembly which overcomes at least some of the above-noted problems of the related art. According to the present invention, a control pedal assembly comprises, in combination, a support structure having a guide surface and a pedal arm carrying a pedal at a lower end of the pedal arm. The pedal arm is pivotable relative to the support structure about a pivot axis between a released position and an applied position. A hysteresis device is secured to an upper end of the pedal arm and engages the guide surface so that the hysteresis device moves along the guide surface as the pivot arm pivots between the released position and the applied position. A distance between the guide surface and the pivot axis varies so that the hysteresis device applies an increasing normal force to the guide surface to create an increasing friction force that opposes motion of the hysteresis device as the pedal arm pivots from the released position to the applied position.

According to another aspect of the present invention, an electronic control pedal assembly comprises, in combination, a support structure having a first guide surface and a second guide surface spaced apart from and facing the first guide surface and a pedal arm carrying a pedal at a lower end of the pedal arm. The pedal arm is pivotable relative to the support structure about a pivot axis between a released position and an applied position. A sensor is operably connected to the pedal arm and provides electronic signals responsive to pivotable movement of the pedal arm about the pivot axis. A hysteresis device is secured to the pedal arm and is engagable with the first and second guide surfaces so that the hysteresis device slides along the first and second guide surfaces as the pivot arm pivots between the released position and the applied position. A distance between the guide surfaces decreases in a direction of travel of the hysteresis device as the pedal arm pivots from the release position to the applied position so that an increasing interference between the support structure and the hysteresis device creates an increasing friction force that opposes sliding motion of the hysteresis device as the pedal arm pivots from the released position to the applied position.

According to yet another aspect of the present invention, an electronic control pedal assembly comprises, in combination, a support structure having a guide surface and a pedal arm carrying a pedal at a lower end of the pedal arm. The pedal arm is pivotable relative to the support structure about a pivot axis between a released position and an applied position. A sensor is operably connected to the pedal arm and provides electronic signals responsive to pivotable movement of the pedal arm about the pivot axis. A hysteresis device includes a plunger axially movable in a cavity formed in an upper end of the pedal arm and having an end engaging the guide surface and a spring member biasing the plunger toward the guide surface so that the end of the plunger slides along the guide surface as the pivot arm pivots between the released position and the applied position. A distance between the guide surface and the pedal arm decreases in a direction of travel of the hysteresis device as the pedal arm pivots from the release position to the applied position so that the plunger is depressed against the bias of the spring member to apply an increasing normal force to the guide surface and create an increasing friction force that opposes sliding motion of the plunger against the guide surface as the pedal arm pivots from the released position to the applied position.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, reliable, low cost universal assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
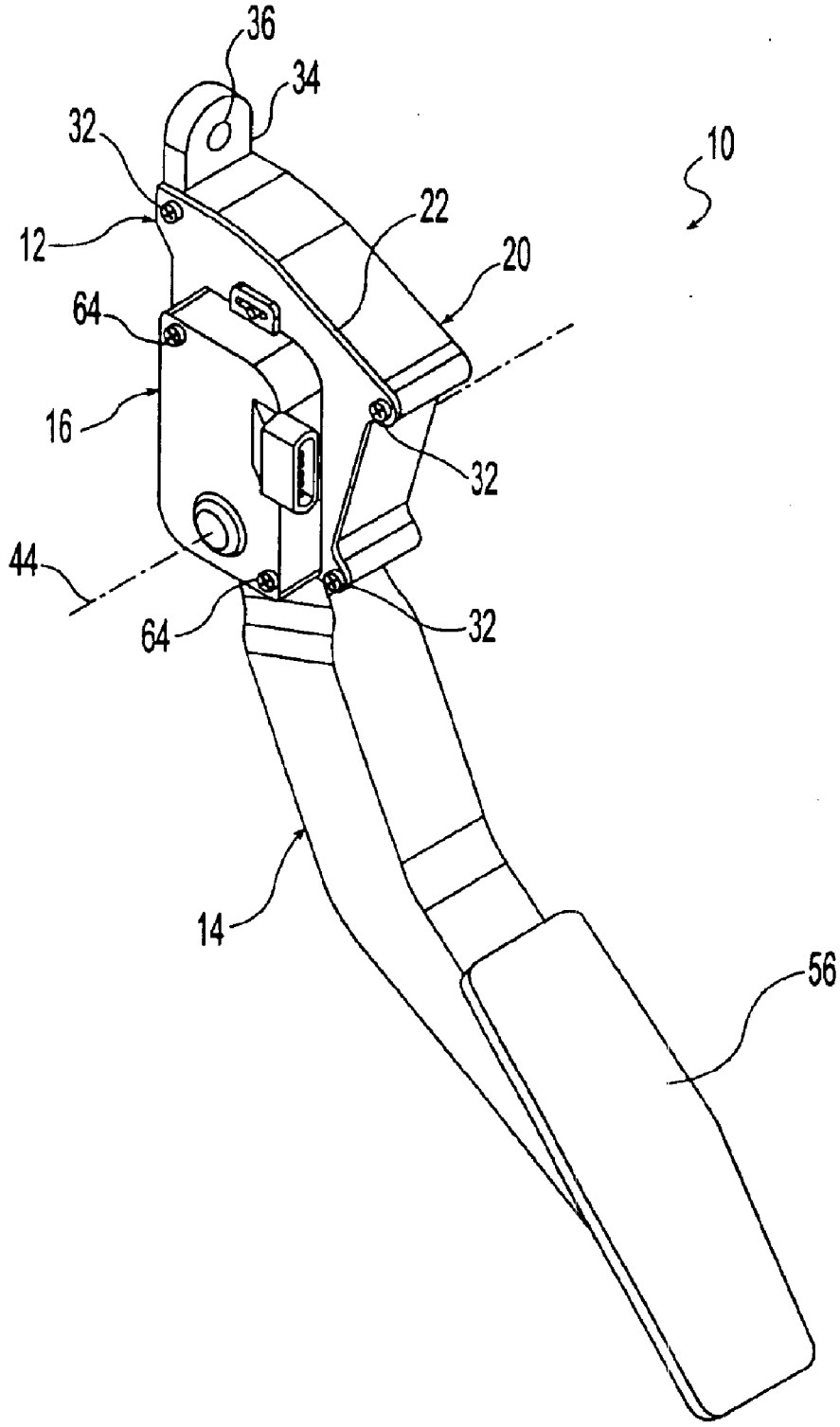
FIG. 1 is a perspective view of a control pedal assembly having a mechanical hysteresis device according to a first embodiment of the present invention.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction within the plane of the paper in FIGS. 3 and 6 and down or downward refers to a downward direction within the plane of the paper in FIGS. 3 and 6. Also in general, fore or forward refers to a direction toward the front of the motor vehicle, that is, a leftward direction within the plane of the paper in FIGS. 3 and 6 and aft or rearward refers to a direction toward the rear of the motor vehicle, that is, a rightward direction within the plane of the paper in FIGS. 3 and 6.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to an electronic accelerator pedal for use with an automobile. Other embodiments suitable for other applications, such as brake or clutch pedals and/or other types of motor vehicles, will be apparent to those skilled in the art given the benefit of this disclosure. The present invention can be utilized with any vehicle having a foot operated control pedal including trucks, buses, vans, recreational vehicles, earth moving equipment and the like, off road vehicles such as dune buggies and the like, air borne vehicles, and water borne vehicles.

Figure 2:
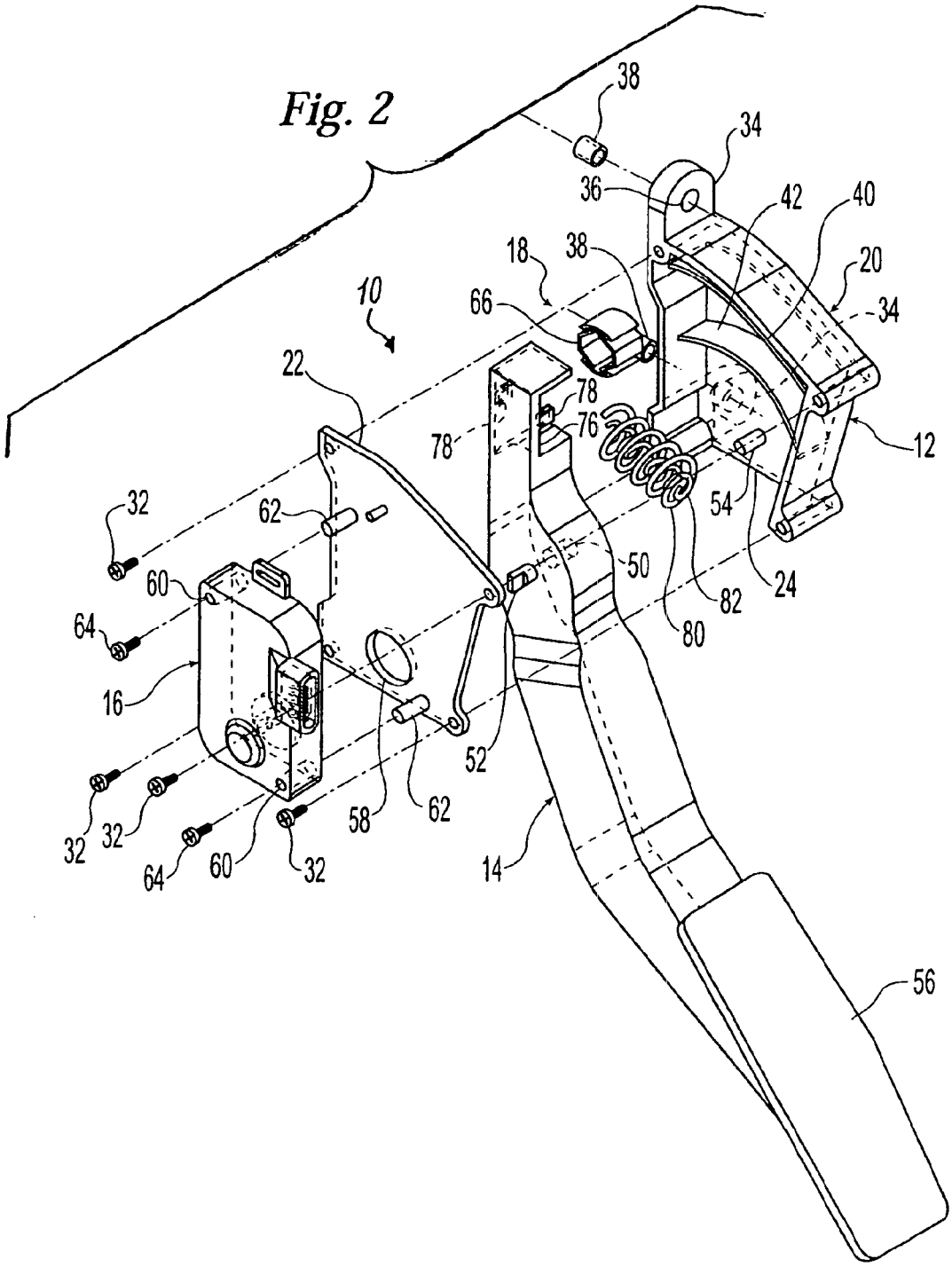
FIG. 2 is an exploded view of the control pedal assembly of FIG. 1.
Figure 3:
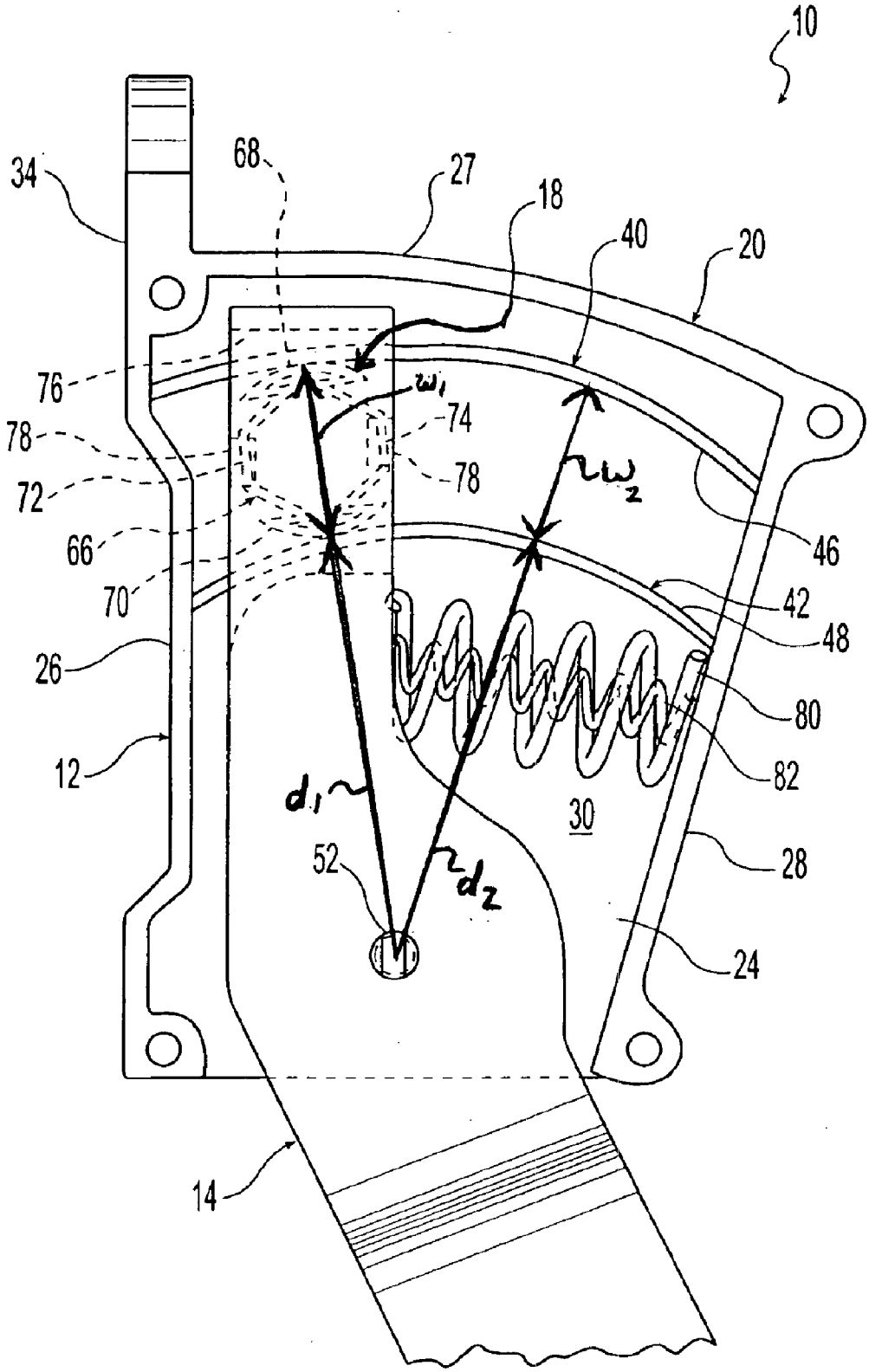
FIG. 3 is an enlarged, fragmented elevational view of the control pedal assembly of FIGS. 1 and 2 in the area of the mechanical hysteresis device.

Referring now to the drawings, FIGS. 1 to 3 show a control pedal assembly 10 for a motor vehicle according to the present invention which is selectively adjustable to a desired position by a driver. The control pedal assembly 10 includes a mounting bracket or support structure 12, a pedal arm 14 pivotally connected to the mounting bracket 12 to be pivotable between a released position R and an applied position A, an electronic throttle control (ETC) sensor 16 operatively connecting to the pedal arm 14 to a control device to provide electrical control signals indicating pivotal movement of the pedal arm 14, and a mechanical hysteresis device 18.

The support structure 12 is sized and shaped for rigid attachment of the adjustable control pedal assembly 10 to a firewall or other suitable support member of the motor vehicle. The support structure 12 may be may be formed of any suitable material such as, for example, a plastic material such as nylon and may be formed in any suitable manner such as, for example, molding. The illustrated support structure 12 includes a housing member 20 and a cover member 22. The illustrated housing member 20 has a planar side wall 24 and front, top, and rear walls 26,27, 28 perpendicularly extending from front, top, and rear edges of the side wall 24 respectively. The illustrated cover member 22 is generally in the form of a plate sized to engage the walls 24, 26, 27, 28 of the housing member 20. The cover member 22 cooperates with the housing member 20 to form a hollow interior space 30 which is closed except for an open bottom. The illustrated cover member 22 is removably secured to the housing member 20 with mechanical fasteners 32 in the form of screws. It is noted, however, that the cover member 22 can be secured to the housing member 20 in any suitable alternative manner such as for example, adhesives, bolts, rivets, welds, clips, locks, snap-fit connections, or the like. The illustrated housing member 20 is provided with a pair of mounting tabs 34 having openings 36 therein for receiving mechanical fasteners to rigidly secure the support structure 12 to the motor vehicle. The openings 36 of illustrated mounting tabs 34 are each provided with a bushing 38. It is noted that the support structure 12 can alternatively be secured to the motor vehicle in any other suitable manner.

Laterally extending from the side wall 24 of the housing member 20 within the interior space 30 is a first or upper guide wall or rail 40 and a second or lower guide wall or rail 42 below and spaced apart from the upper guide wall 40. The guide walls 40, 42 extend in the forward rearward direction from the front wall 26 to the rear wall 28 and in the lateral direction from the side wall 24 to a location spaced apart from the cover member 22 for passage of the pedal arm 14 between the cover member 22 and the guide walls 40, 42. The guide walls 40, 42 are each arcuate or curved and are located above a pivot axis 44 of the pedal arm 14 such that they are concave relative to the pivot axis 44. The bottom of the upper guide wall 40 forms a first or upper guide surface 46 and the top of the lower guide wall forms a second or lower guide surface 48. The upper and lower guide surfaces 46, 48 are spaced apart and facing each other. The upper and lower guide surfaces 46, 48 are sized and shaped to cooperate with the mechanical hysteresis device 18 as described in more detail hereinafter. Preferably, at least a portion of at least one of the guide surfaces 46, 48 is non-linear or arcuate. In the illustrated embodiment, both of the guide surfaces 46, 48 are entirely nonlinear or arcute over the path of the hysteresis device 18.

The pedal arm 14 is sized and shaped for pivotal attachment to the support structure 12. The pedal arm 14 may be may be formed of any suitable material such as, for example, a plastic material like nylon and may be formed in any suitable manner such as, for example, molding. The illustrated pedal arm 14 is generally elongate and has an upper end forming a laterally extending opening 50 on one lateral side and a pivot pin 52 extending from the other lateral side and coaxial with the opening 50. The pivot pin 52 and the opening 50 cooperate to form the laterally extending pivot axis 44 for the pedal arm 14. The opening 50 is sized and shaped for receiving a pivot pin 54 laterally extending from the side wall 24 of the housing member 20 within the interior space 30. The pivot pin 52 is sized and shaped for extending into the ETC sensor 16. Mounted in this manner the upper end of the pedal arm 14 extends into the interior space 30 through the open bottom of the support structure 12 and is pivotably secured to the support structure 12 for rotation about the pivot axis 44. It is noted that the pedal arm 14 can be pivotably secured to the support structure 12 in other suitable manners within the scope of the present invention.

The elongate pedal arm 14 extends generally downward from the pivot axis 44. The lower end of the pedal arm 14 carries a pedal 56. The pedal 56 of the illustrated embodiment is formed unitary with the pedal arm 14, that is, molded of a single piece but the pedal 56 can alternatively be partially or fully formed of a separate piece or pieces and attached together.

The pedal arm 14 is operatively connected to the control device such as a throttle via the ETC sensor 16 so that pivotal movement of the pedal arm 14 about the pivot axis 44 operates the control device in a desired manner. The illustrated ETC sensor 16 is a rotational sensor adapted to sense rotation of the pedal arm 14. The illustrated ETC sensor 16 secured to the support structure 12 at the cover member 22 through which the pivot pin 52 extends through an opening 58 to the ETC sensor 16 for cooperation therewith. The illustrated ETC sensor 16 is provided with a pair of openings 60 sized and shaped to receive a pair of pins 62 therein. The pins 62 laterally extend from the outer side of the cover member 22. Mechanical fasteners 64 in the form of screws extend into the pins 62 to secure the ETC sensor 16 to the cover member 22. It is noted that the ETC sensor alternatively can be secured to the support structure in any other suitable manner. It is also noted that the ETC sensor 16 can be any suitable rotational sensor known to those skilled in the art or can be any other suitable type of sensor known to those skilled in the art such as, for example, a force sensor adapted to sense the amount of force applied to the pedal arm 14. The ETC sensor 16 is in electrical communication, such as connected via wires or wireless communication devices, with the control device to provide electrical signals indicating rotational movement of the pedal arm 14.

The illustrated mechanical hysteresis device 18 includes a resilient spring member 66 carried by the upper end of the pedal arm 14 and engageable with both the upper and lower guide surfaces 46, 48. The illustrated spring member 66 is an extrusion formed by a wall forming an exterior surface and having a hollow interior open on lateral sides thereof. The spring member 66 has upper and lower engagement portions 68, 70 sized and shaped for engaging the upper and lower guide surfaces 46, 48 respectively. The illustrated engagement portions 68, 70 are arcuate and convex at their exterior side. The engagement portions 68, 70 are secured together at their forward and rearward ends by forward and rearward connecting portions 72, 74. The illustrated connecting portions 72, 74 are in the form of vertically disposed planar walls. Formed in this manner, the spring member 66 is resiliently deformable as describe in more detail hereinafter.

The upper end of the pedal arm 14 is provided with a notch or seat 76 for receiving the spring member 66 which is located above the pivot axis 44, that is, on the opposite side of the pivot axis 44 from the pedal 56. The illustrated notch 76 is open at its forward and rearward sides and the lateral side facing the side wall 24 of the housing member 20 and is open at its top and bottom sides and the lateral side facing the cover member 22. A top surface of the notch 76 is downward facing and is disposed above the upper guide wall 40. A bottom surface of the notch 76 is upward facing and is disposed below the lower guide wall 42. The spring member 66 is located between the upper and lower surfaces of the notch 76 so that the spring member 66 is located between the upper and lower guide walls 40, 42. The illustrated spring member 66 is secured to the pedal arm by two pairs of mounting tabs 78 engaging the connecting portions 72, 74 of the spring member 66. The mounting tabs 78 are each planar and extend laterally from the lateral side surface of the notch 76. Each pair of mounting tabs 78 are sized and shaped to receive one of the spring member connecting portions 72, 74 therebetween. With each of the connecting portions 72, 74 extending between respective pairs of the mounting tabs 78, the spring member 66 is held in place within the notch 76.

Positioned between the upper and lower guide walls 40, 42, the spring member upper and lower engagement portions 68, 70 respectively engage the upper and lower guide surfaces 46, 48. As the pedal arm 14 pivots, the spring member upper and lower engagement portions 68, 70 slide along the upper and lower guide surfaces 46, 48 respectively. The upper and lower guide surfaces 46, 48 are sized and shaped so that the spring member 66 is compressed between the guide surfaces 46, 48 as the spring member 66 moves rearward between the guide surfaces 46, 48. That is, the distance $w_1$, $w_2$ between the guide surfaces 46, 48 decreases in a rearward direction. Preferably, a distance $d_1$, $d_2$ between at least one of the guide surfaces 46, 48 and the pivot axis 44 varies so that the spring member 66 applies an increasing normal force to the guide surface 46, 48 to create an increase friction force that opposes sliding motion of the spring member 66 as the pedal arm 14 pivots and moves the spring member 66 in a rearward direction. In the illustrated embodiment, the distance between each of the guide surfaces 46, 48 and the pivot axis 44 varies in this manner.

Return springs 80, 82 are located within the interior cavity 30 of the support structure 12 and are adapted to resiliently bias the pedal arm 14 to the fully rearward or undepressed position (shown in FIG. 3). The illustrated first and second return springs 80, 82 are coaxial helical coil compression springs of differing coil diameters. It is noted, however, that return springs 80, 82 of other types can be utilized to urge or bias the pedal arm to the fully undepressed or idle position. The forward ends of the illustrated return springs 80, 82 engage the upper end of the pedal arm 14 while the rearward ends of the illustrated return springs 80, 82 engage the interior surface of the rear wall 28 of the housing member 20. It is noted that the control pedal assembly 10 can operate with only one of the return springs 80, 82 but the other one of the return springs 80, 82 is provided for redundancy as a protection against spring failure and/or more desirable sizing of the return springs.

Figure 4:
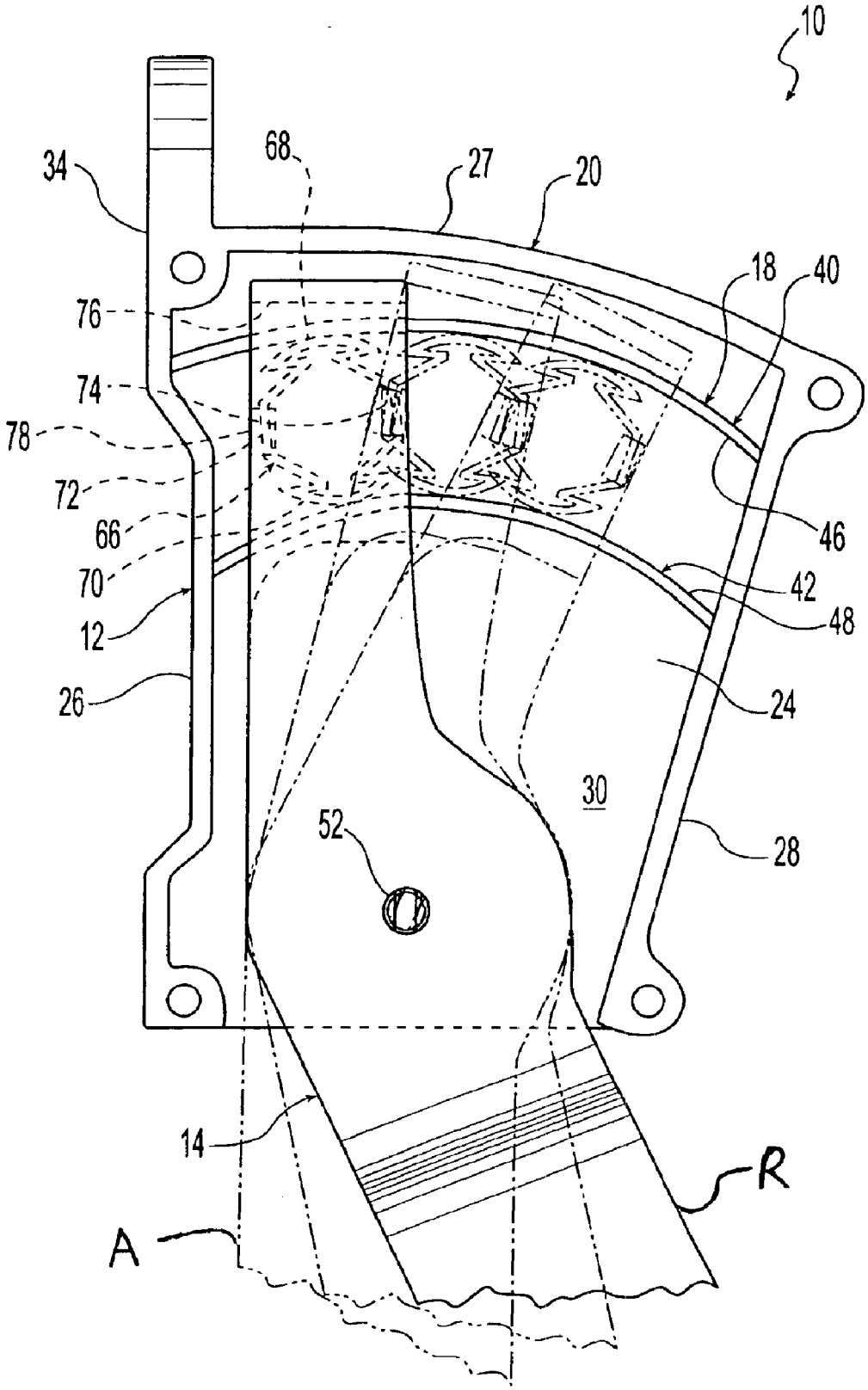
FIG. 4 is an enlarged, fragmented elevational view of the control pedal assembly similar to FIG. 3 showing operation of the mechanical hysteresis device as the pedal arm pivots with return springs removed for clarity.

Installed in this manner, the return springs 80, 82 engage the forward side of the pedal arm 14 near and above the pivot axis 44 to bias the pedal arm 14 to an idle position when no pressure is applied to the pedal. During operation of the motor vehicle, the operator depresses the pedal 56 using a foot to control the motor vehicle. The pressure on the pedal 56 pivots the pedal arm 14 about the pivot axis 44 against the bias of the return springs 80, 82. As the pedal arm 14 rotates, the ETC sensor 16 detects the rotation and sends electrical signals indicating the magnitude of rotation to the control device to control the motor vehicle. As the pedal arm 14 rotates, the pedal arm 14 moves the spring member 66 rearward along the upper and lower guide surfaces 46, 48. As best shown in FIG. 4, the engagement portions 68, 70 are resiliently squeezed together or forced toward one another by the wedge action provided by the guide surfaces 46, 48 as the spring member 66 slides rearward along the guide surfaces 46, 48. It is noted that the wedge action creates an increasing normal force acting on the guide surfaces 46, 48 by the spring member 66. This increasing normal force generates increasing friction between the spring member 66 and the guide surfaces 46, 48. It is noted that the materials of the spring member 66 and the guide surfaces 46, 48 are selected to obtain desired friction. Preferably, there is plastic to plastic contact to obtain the desired friction. It should be appreciated by one skilled in the art that differing requirements of the control pedal assembly 10 can be met by, for example, varying the location and shape of the guide walls 40, 42, the force provided by the spring member 66, and/or other variables. When pressure is maintained on the pedal 26, the friction between the spring member 66 and the guide surfaces 46, 48 assists in maintaining the pedal arm 14 in its current position. Increased pressure is required on the pedal 56 to overcome the increasing friction and further advance the pedal 56. As the spring member 66 is compressed, it is preferably wedged in an inward direction with increasing force so that the hysteresis device 18 provides variable friction. When pressure is removed from the pedal 56, the return springs 80, 82 resiliently return the pedal arm 14 to the idle position. As the pedal arm 14 returns, the spring member 66 slides forward along the guide walls 40, 42 and resiliently decompresses to maintain engagement with the guide walls 40, 42 with decreasing force.

Figure 5:
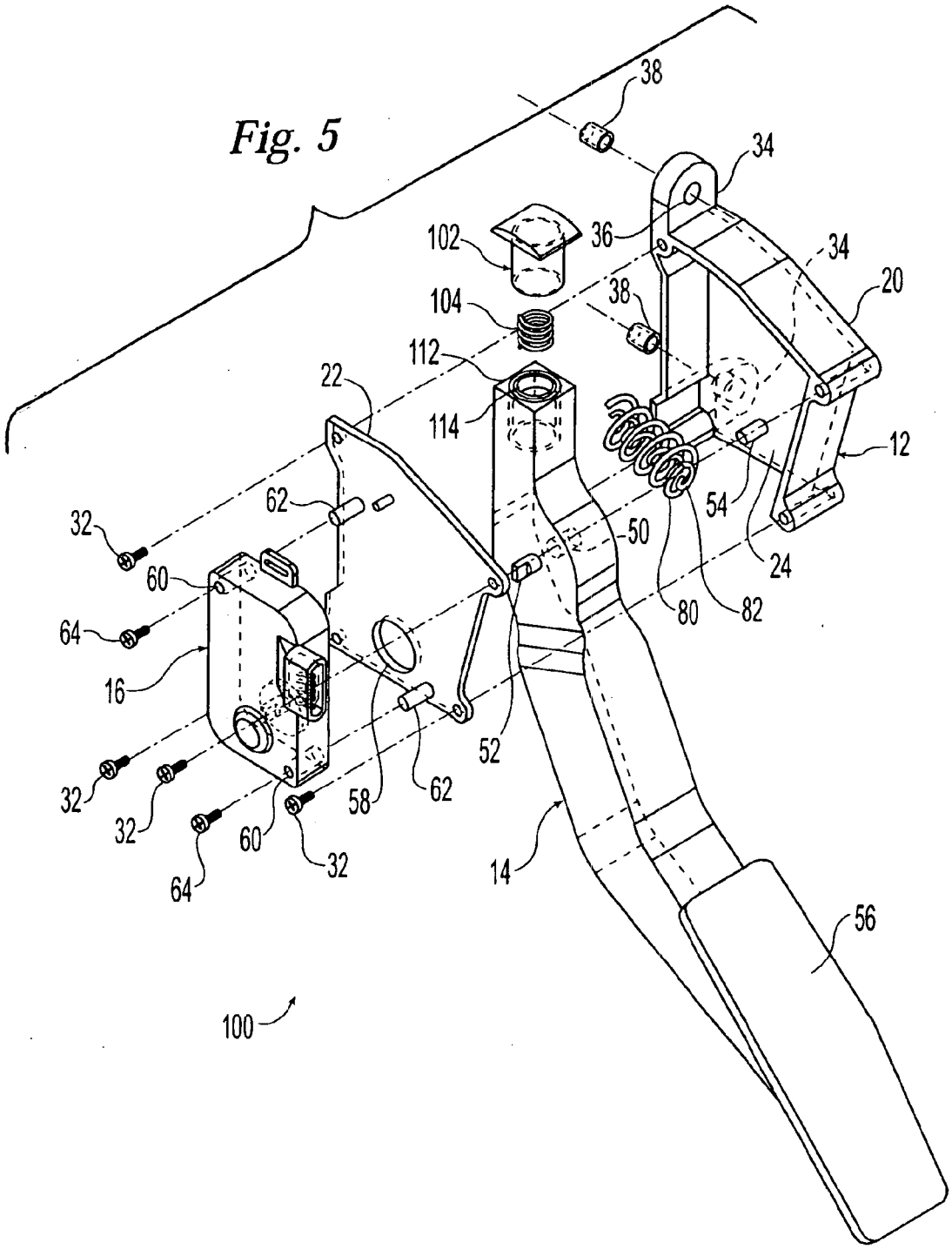
FIG. 5 is an exploded view of a control pedal assembly having a mechanical hysteresis device according to a second embodiment of the present invention.
Figure 6:
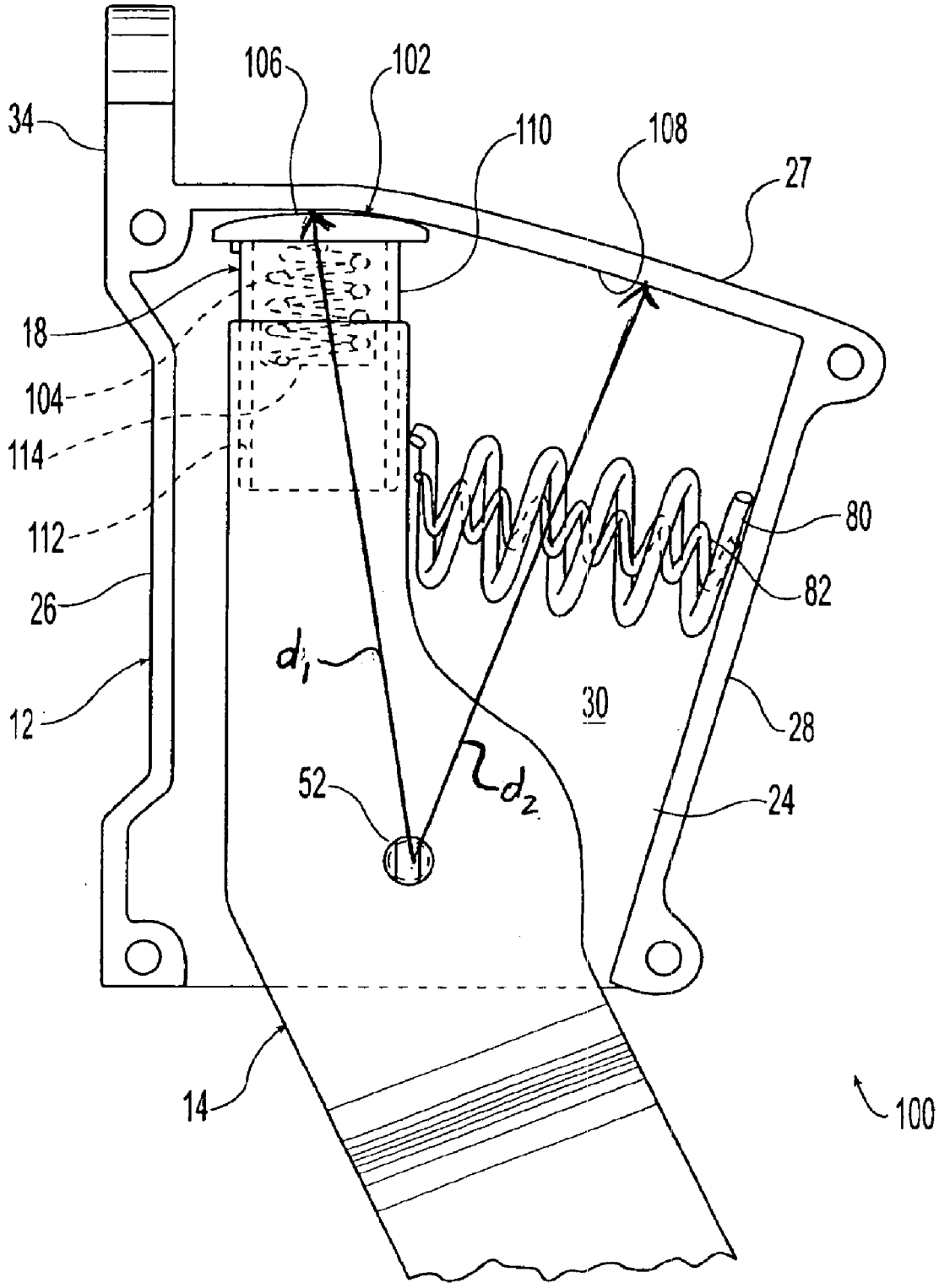
FIG. 6 is an enlarged, fragmented elevational view of the control pedal assembly of FIG. 5 in the area of the mechanical hysteresis device.
Figure 7:
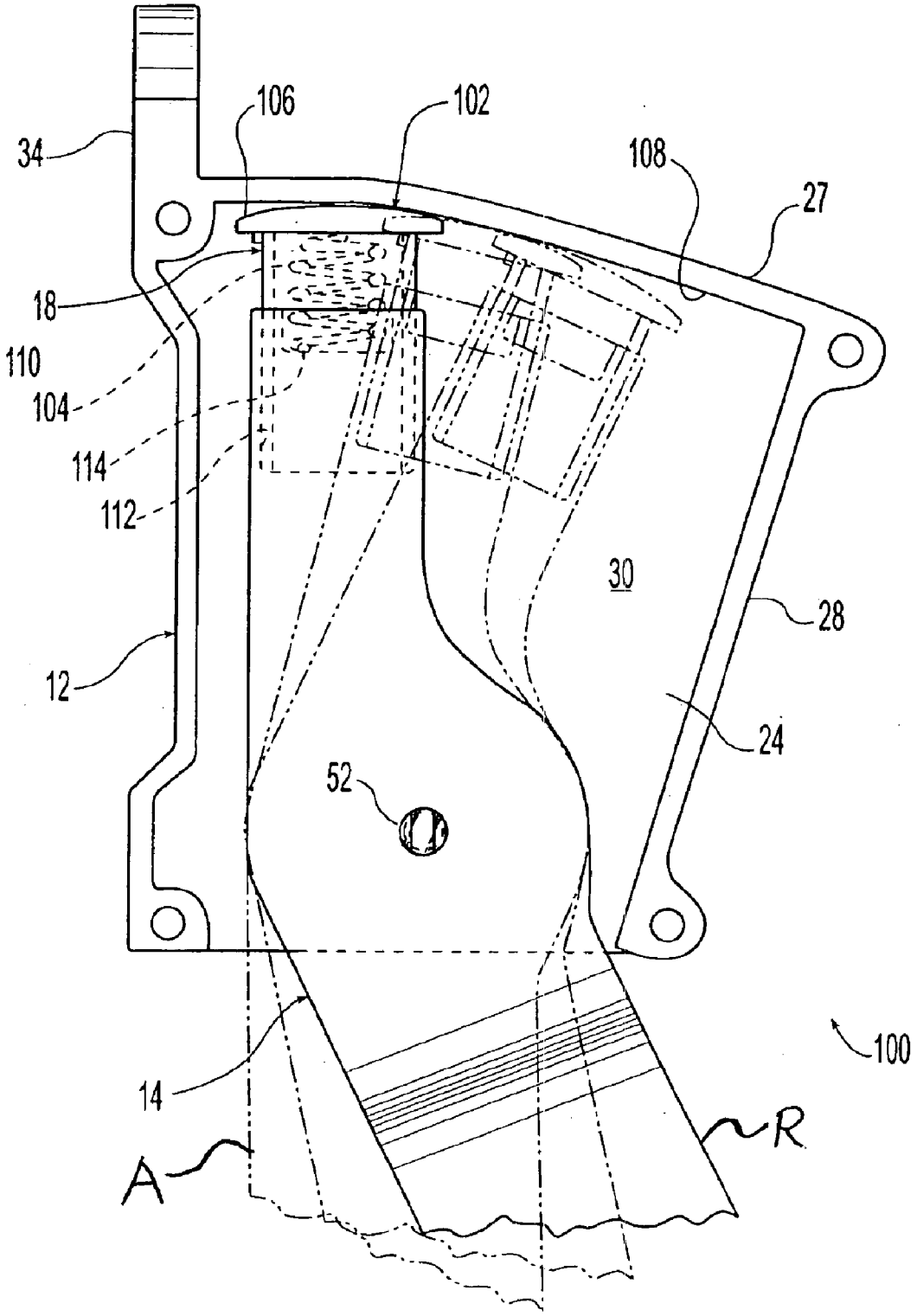
FIG. 7 is an enlarged, fragmented elevational view of the control pedal assembly similar to FIG. 6 showing operation of the mechanical hysteresis device as the pedal arm pivots with return springs and a hysteresis device spring removed for clarity.

FIGS. 5 to 7 illustrate a control pedal assembly 100 according to a second embodiment of the present invention wherein like reference numbers are utilized for like structure. The control pedal assembly 100 according to the second embodiment of the invention is substantially similar to the control pedal assembly 10 according to the first embodiment of the invention except that the mechanical hysteresis device 18 is in a different form.

The illustrated mechanical hysteresis device 18 includes a plunger 102 and a resilient spring member 104 biasing the plunger 102. The plunger and spring member 102, 104 are each carried by the upper end of the pedal arm 14 above the pivot axis 44. The plunger 102 has an engagement portion 106 sized and shaped for engaging a guide surface 108 and a guide portion 110. The illustrated engagement portion 106 is generally in the form of a block having arcuate upper surface. The illustrated guide portion 110 is in the form of a hollow tube downwardly extending from the lower surface of the engagement portion. The illustrated spring member 104 is a helical coil compression spring sized and shaped to be disposed within the guide portion 110 and engaging the lower surface of the engagement portion 106 to bias the plunger 102 as described in more detail hereinafter. It is noted that the spring member 104 can take many different forms within the scope of the present invention such as, for example, a leaf spring, a block spring, a helical-coil tension spring, a fluid spring, or the like.

The upper end of the pedal arm 14 is provided with an annular-shaped opening or cavity 112 sized and shaped for closely receiving the guide portion 110 of the plunger 102 therein for sliding movement of the plunger 102 into and out of the opening 112. The pedal arm 14 is preferably provided with a seat 114 for receiving the spring member 104 that is located within the opening 112. The guide portion 110 of the plunger 102 is positioned within the opening 112. The spring member 104 is positioned within the guide portion 110 of the plunger 102 and acts between the pedal arm seat 114 and the plunger engagement portion 106 to resiliently bias the plunger 102 in a direction out of the opening 112 and toward the guide surface 108. The illustrated guide surface 108 is formed by the bottom of the top wall 27 of the housing member 20. It is noted that alternatively a separate guide wall can be provided to form the guide surface 108.

Positioned between the pedal arm 14 and the guide surface 108, the spring biased plunger 102 resiliently engages the guide surface 108. As the pedal arm 14 pivots, the plunger engagement portion 106 slides along the guide surface 108. The guide surface 108 is sized and shaped so that the plunger 102 is compressed against the bias of the spring member 104 as the plunger 102 moves rearward along the guide surface 108. That is, the distance $d_1$, $d_2$ between the guide surface 108 and the pivot axis 44 decreases in a rearward direction so that the plunger 102 applies an increasing normal force to the guide surface 108 to create an increase friction force that opposes sliding motion of the plunger 102 as the pedal arm 14 pivots and moves the plunger 102 in a rearward direction.

Installed in this manner, the return springs 80, 82 engage the forward side of the pedal arm 14 near and above the pivot axis 44 to bias the pedal arm 14 to an idle position when no pressure is applied to the pedal 56. During operation of the motor vehicle, the operator depresses the pedal 56 using a foot to control the motor vehicle. The pressure on the pedal 56 pivots the pedal arm 14 about the pivot axis 44 against the bias of the return springs 80, 82. As the pedal arm 14 rotates, the ETC sensor 16 detects the rotation and sends electrical signals indicating the magnitude of rotation to the control device to control the motor vehicle. As the pedal arm 14 rotates, the pedal arm 14 moves the plunger 102 rearward along the guide surface 108. As best shown in FIG. 7, the plunger 102 is resiliently depressed against the bias of the spring member 104 by the wedge action provided by the guide surface 108 as the plunger 102 slides rearward along the guide surface 108. It is noted that the wedge action creates an increasing normal force acting on the guide surface 108 by the plunger 102. This increasing normal force generates increasing friction between the plunger 102 and the guide surface 108. It is noted that the materials of the plunger 102 and the guide surface 108 are selected to obtain desired friction. Preferably, there is plastic to plastic contact to obtain the desired friction. It should be appreciated by one skilled in the art that differing requirements of the control pedal assembly 100 can be met by, for example, varying the location and shape of the guide wall 108, the size and shape of the plunger 102, the force provided by the spring member 104, and/or other variables. When pressure is maintained on the pedal 56, the friction between the plunger 102 and the guide surface 108 assists in maintaining the pedal arm 14 in its current position. Increased pressure is required on the pedal 56 to overcome the increasing friction and further advance the pedal 56. As the plunger 102 is depressed, it is preferably moved inward with increasing force so that the hysteresis device 18 provides variable friction. When pressure is removed from the pedal 56, the return springs 80, 82 resiliently return the pedal arm 14 to the idle position. As the pedal arm 14 returns, the plunger 102 slides forward along the guide surface 108 and the spring member 104 resiliently biases the plunger 102 outward to maintain engagement between the plunger 102 and guide surface 108 with decreasing force.

From the above description, it should be appreciated that the present invention provides a control pedal assembly 10, 100 which is relatively simple and inexpensive to produce and is highly reliable in operation. It should also be appreciated that the various features of each illustrated embodiment can be utilized with the other illustrated embodiments.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the control pedal assembly be an adjustable pedal assembly wherein a drive assembly selectively adjusts the disclosed control pedal assembly in a forward/rearward direction relative to the steering wheel/seat of the motor vehicle. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal assembly comprising, in combination:

a support structure having a guide surface;

a pedal arm carrying a pedal at a lower end of the pedal arm;

wherein the pedal arm is pivotable relative to the support structure about a pivot axis between a released position and an applied position;

wherein the guide surface is fixed in position to prevent movement relative to the pivot axis as the pedal arm pivots between the released position and the applied position;

a hysteresis device secured to an upper end of the pedal arm and engaging the guide surface so that the hysteresis device moves along the guide surface as the pedal arm pivots between the released position and the applied position;

wherein a distance between the guide surface and the pivot axis varies so that the hysteresis device applies an increasing normal force to the guide surface to create an increasing friction force that opposes motion of the hysteresis device as the pedal arm pivots from the released position to the applied position; and wherein the hysteresis device is resiliently deflected as the hysteresis device moves along the guide surface when the pedal arm pivots between the released position and the applied position.

2. The control pedal assembly according to claim 1, further comprising a return spring engaging an upper end of the pedal arm and biasing the pedal arm toward the released position.

3. The control pedal assembly according to claim 2, wherein the pivot axis is located between the pedal and the engagement of the return spring with the pedal arm.

4. The control pedal assembly according to claim 1, further comprising a sensor operably connected to the pedal arm and providing electronic signals responsive to pivotable movement of the pedal arm about the pivot axis.

5. The control pedal assembly according to claim 1, wherein at least a portion of the guide surface is non-linear along a sliding path of the hysteresis device.

6. The control pedal assembly according to claim 1, further comprising another guide surface spaced apart from the guide surface and wherein the hysteresis device is located between the guide surface and the another guide surface and engaging both the guide surface and the another guide surface.

7. The control pedal assembly according to claim 6, wherein the guide surface and the another guide surface are each curved along a path of the hysteresis device.

8. The control pedal assembly according to claim 6, wherein the another guide surface is facing the guide surface.

9. The control pedal assembly according to claim 6, wherein a distance between the guide surfaces decreases in a direction of travel of the hysteresis device as the pedal arm pivots from the release position to the applied position forming an increasing interference between the support structure and the hysteresis device that creates the increasing friction force that opposes motion of the hysteresis device as the pedal arm pivots from the released position to the applied position.

10. The control pedal assembly according to claim 1, wherein the hysteresis device includes a plunger axially movable relative to the pedal arm and having an end engaging the guide surface.

11. The control pedal assembly according to claim 10, wherein the hysteresis device includes a spring member biasing the plunger toward the guide surface.

12. The control pedal assembly according to claim 11, wherein a distance between the guide surface and the pedal arm decreases in a direction of travel of the hysteresis device as the pedal arm pivots from the release position to the applied position so that the plunger is depressed against the bias of the spring member to apply an increasing normal force to the guide surface and create the increasing friction force that opposes sliding motion of the plunger against the guide surface as the pedal arm pivots from the released position to the applied position.

13. The control pedal assembly according to claim 10, wherein the plunger axially slides within an opening formed in the pedal arm.

14. An electronic control pedal assembly comprising, in combination:

a support structure having a first guide surface and a second guide surface spaced apart from and facing the first guide surface;

a pedal arm carrying a pedal at a lower end of the pedal arm;

wherein the pedal arm is pivotable relative to the support structure about a pivot axis between a released position and an applied position;

wherein the first guide surface and the second guide surface are each fixed in position to prevent movement relative to the pivot axis as the pedal arm pivots between the released position and the applied position;

a sensor operably connected to the pedal arm and providing electronic signals responsive to pivotable movement of the pedal arm about the pivot axis;

a hysteresis device secured to the pedal arm and engagable with the first and second guide surfaces so that the hysteresis device slides along the first and second guide surfaces as the pedal arm pivots between the released position and the applied position;

wherein a distance between the guide surfaces decreases in a direction of travel of the hysteresis device as the pedal arm pivots from the release position to the applied position so that an increasing interference between the support structure and the hysteresis device creates an increasing friction force that opposes sliding motion of the hysteresis device as the pedal arm pivots from the released position to the applied position; and wherein the hysteresis device is resiliently deflected as the hysteresis device moves along the guide surface when the pedal arm pivots between the released position and the applied position.

15. The electronic control pedal assembly according to claim 14, wherein the first and second guide surfaces are each curved along a sliding path of the hysteresis device.

16. The electronic control pedal assembly according to claim 14, wherein the hysteresis device includes a resiliently deformable spring member.

17. An electronic control pedal assembly comprising, in combination:

a support structure having a guide surface;

a pedal arm carrying a pedal at a lower end of the pedal arm;

wherein the pedal arm is pivotable relative to the support structure about a pivot axis between a released position and an applied position;

wherein the guide surface is fixed in position to prevent movement relative to the pivot axis as the pedal arm pivots between the released position and the applied position;

a sensor operably connected to the pedal arm and providing electronic signals responsive to pivotable movement of the pedal arm about the pivot axis;

a hysteresis device secured to an upper end of the pedal arm and engaging the guide surface so that the hysteresis device moves along the guide surface as the pedal arm pivots between the released position and the applied position;

wherein the hysteresis device includes a plunger axially movable in a cavity formed in an upper end of the pedal arm and having an end engaging the guide surface and spring member biasing the plunger toward the guide surface so that the end of the plunger slides along the guide surface as the pivot pedal arm pivots between the released position and the applied position;

wherein a distance between the guide surface and the pivot axis varies so that the hysteresis device applies an increasing normal force to the guide surface to create an increasing friction force that opposes motion of the hysteresis device as the pedal arm pivots from the released position to the applied position;

the distance between the guide surface and the pivot axis decreases in a direction of travel of the hysteresis device as the pedal arm pivots from the release position to the applied position so that the plunger is depressed against the bias of the spring member to apply an increasing normal force to the guide surface and create an increasing friction force that opposes sliding motion of the plunger against the guide surface as the pedal arm pivots from the released position to the applied position; and wherein the hysteresis device is resiliently deflected as the hysteresis device moves along the guide surface when the pedal arm pivots between the released position and the applied position.

18. The electronic control pedal assembly according to claim 17, wherein the pivot axis of the pedal is located between the plunger and the pedal.

19. The electronic control pedal assembly according to claim 18, wherein the guide surface is non-linear along a sliding path of the plunger.

* * * * *